US011393608B2

(12) United States Patent
Cho et al.

(10) Patent No.: US 11,393,608 B2
(45) Date of Patent: Jul. 19, 2022

(54) FABRIC MATERIAL-BASED FLEXIBLE ELECTRODE AND MANUFACTURING METHOD THEREOF

(71) Applicant: Korea University Research and Business Foundation, Seoul (KR)

(72) Inventors: Jinhan Cho, Seoul (KR); Seung-Hui Woo, Seongnam-si (KR); Donghyeon Nam, Seoul (KR)

(73) Assignee: Korea University Research and Business Foundation, Seoul (KR)

( * ) Notice: Subject to any disclaimer, the term of this patent is extended or adjusted under 35 U.S.C. 154(b) by 10 days.

(21) Appl. No.: 16/764,141

(22) PCT Filed: Aug. 14, 2018

(86) PCT No.: PCT/KR2018/009302
§ 371 (c)(1),
(2) Date: May 14, 2020

(87) PCT Pub. No.: WO2019/098498
PCT Pub. Date: May 23, 2019

(65) Prior Publication Data

US 2020/0343016 A1 Oct. 29, 2020

(30) Foreign Application Priority Data

Nov. 16, 2017 (KR) ..... 10-2017-0152968

(51) Int. Cl.
*H01B 5/14* (2006.01)
*H01B 1/02* (2006.01)
(Continued)

(52) U.S. Cl.
CPC ..... *H01B 5/14* (2013.01); *C25D 7/00* (2013.01); *D06M 11/83* (2013.01);
(Continued)

(58) Field of Classification Search
None
See application file for complete search history.

(56) References Cited

U.S. PATENT DOCUMENTS 3,703,413 A * 11/1972 Arrance ..... H01M 4/244 429/217
2004/0053049 A1* 3/2004 Tsunashima ..... D06M 11/83 428/375
(Continued)

FOREIGN PATENT DOCUMENTS

JP 2016-056407 A 4/2016
KR 10-2013-0126796 A 11/2013
(Continued)

OTHER PUBLICATIONS

English machine translation of Hachitsuka et al. (JP 2016-056407 A) accessed online from Espacenet; PDF pp. 1-18. (Year: 2016).*
(Continued)

*Primary Examiner* — Katie L. Hammer
(74) *Attorney, Agent, or Firm* — NSIP Law

(57) ABSTRACT

The present invention relates to a fabric material-based flexible electrode and a manufacturing method thereof, and a fabric material-based flexible electrode according to the present invention comprises: a substrate (10) including multiple fibers (11) crossing each other; a bonding layer (20), on the substrate (10), including an amine group (NH2)-containing monomolecular substance adsorbed thereon; a nanoparticle layer (30), on the bonding layer (20), having metallic nanoparticles (31) coated thereon; and a plating layer (40), on the nanoparticle layer (30), having a predetermined metal electroplated thereon.

11 Claims, 2 Drawing Sheets

(51) Int. Cl.

| | |
|---|---|
| ***H01B 13/22*** | (2006.01) |
| ***D06M 11/83*** | (2006.01) |
| ***D06M 13/325*** | (2006.01) |
| ***D06M 13/332*** | (2006.01) |
| ***C25D 7/00*** | (2006.01) |
| ***D06M 23/08*** | (2006.01) |
| ***H01B 7/04*** | (2006.01) |
| ***H01B 13/32*** | (2006.01) |
| ***D06M 13/335*** | (2006.01) |
| ***C25D 3/12*** | (2006.01) |
| ***H01B 13/00*** | (2006.01) |

(52) U.S. Cl.

CPC ..... *D06M 13/325* (2013.01); *D06M 13/332* (2013.01); *D06M 13/335* (2013.01); *D06M 23/08* (2013.01); *H01B 1/023* (2013.01); *H01B 1/026* (2013.01); *H01B 7/04* (2013.01); *H01B 13/222* (2013.01); *H01B 13/32* (2013.01); *C25D 3/12* (2013.01); *H01B 13/0026* (2013.01)

(56) References Cited

U.S. PATENT DOCUMENTS

2015/0174613 A1* 6/2015 Kim ..... C23C 18/04 427/551
2015/0294756 A1* 10/2015 Ben Shalom ..... D06B 1/00 340/573.7

FOREIGN PATENT DOCUMENTS

KR 10-2016-0061346 A 5/2016
KR 10-1710808 B1 2/2017
KR 10-2017-0030707 A 3/2017

OTHER PUBLICATIONS

International Search Report dated Nov. 15, 2018 in corresponding International Patent Application No. PCT/KR2018/009302 (2 pages in English, 2 pages in Korean).

* cited by examiner

[Fig. 1]
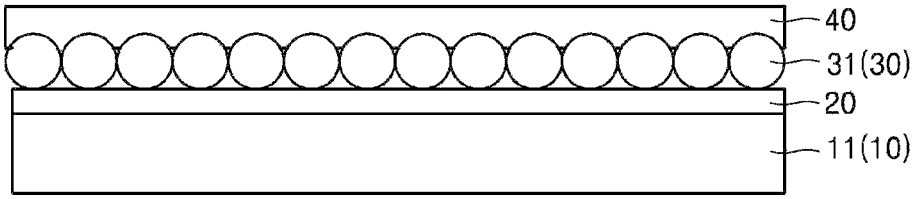
[Fig. 2]
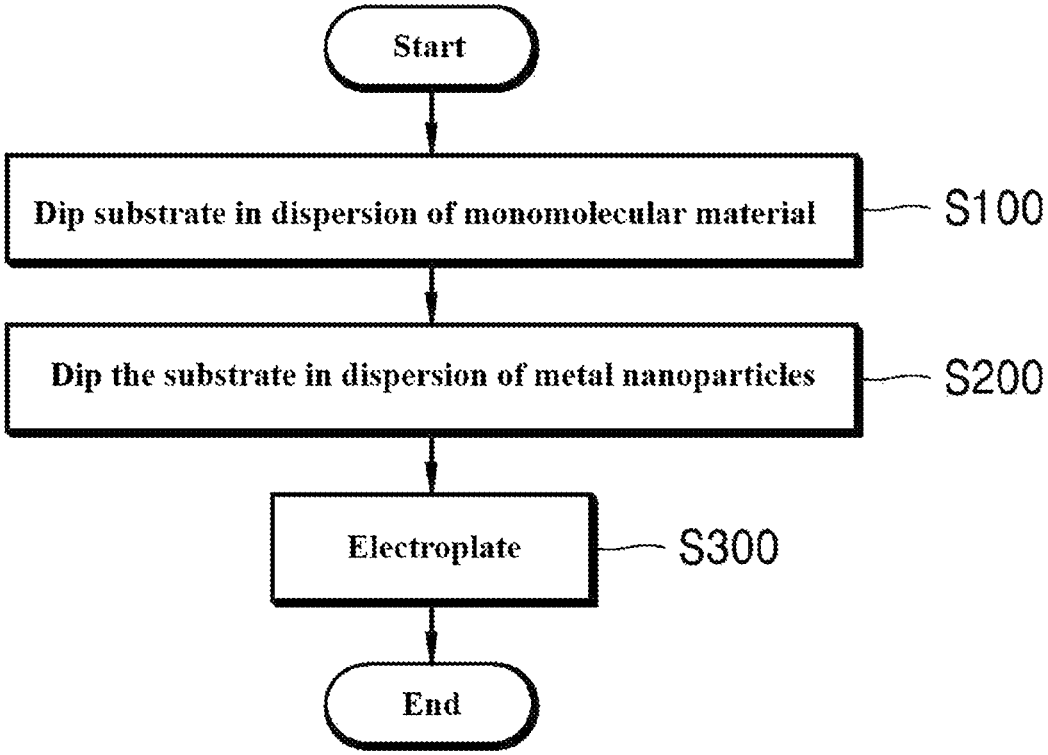

[Fig. 3]
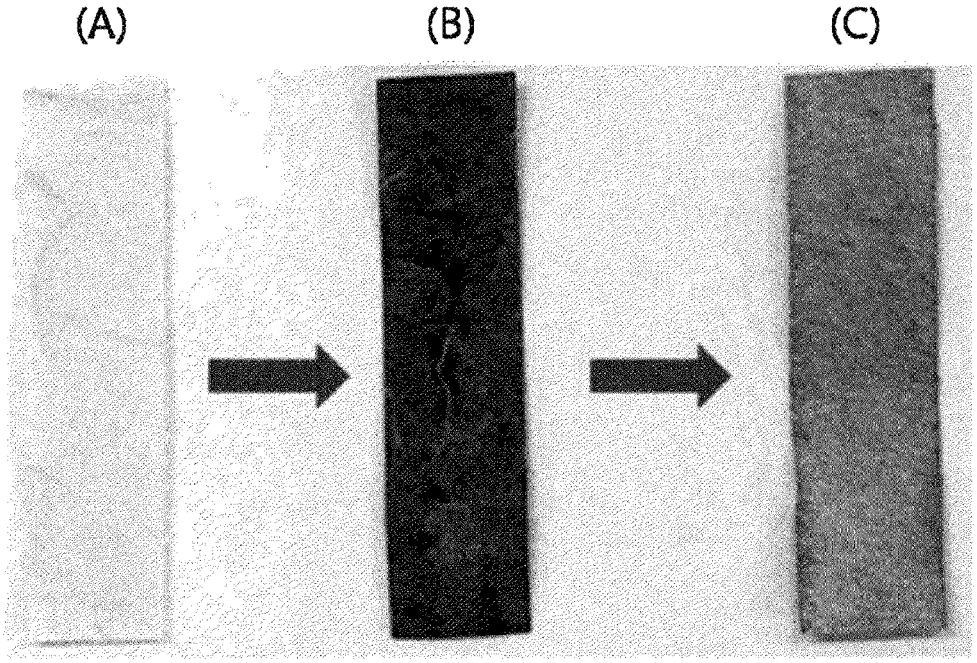
[Fig. 4]
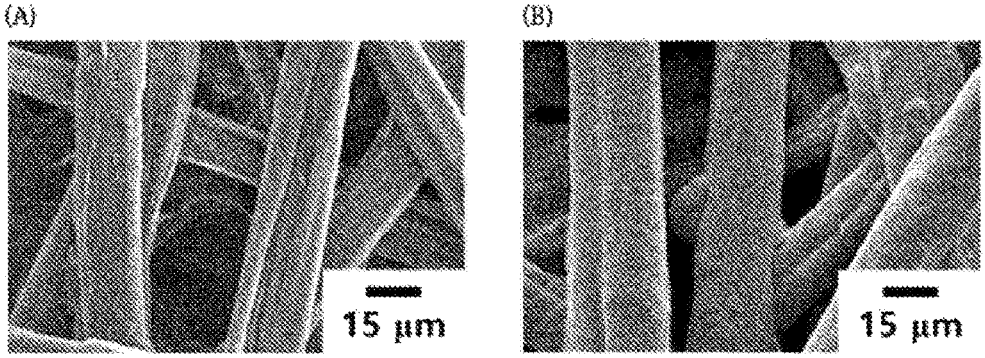

FABRIC MATERIAL-BASED FLEXIBLE ELECTRODE AND MANUFACTURING METHOD THEREOF

CROSS REFERENCE TO RELATED APPLICATIONS

This application is a U.S. National Stage Application of International Application No. PCT/KR2018/009302, filed on Aug. 14, 2018, which claims the benefit under 35 USC 119(a) and 365(b) of Korean Patent Application No. 10-2017-0152968, filed on Nov. 16, 2017 in the Korean Intellectual Property Office, the entire disclosure of which is incorporated herein by reference for all purposes.

TECHNICAL FIELD

The present invention relates to a fabric-based flexible electrode and a method for manufacturing the same. More specifically, the present invention relates to a flexible electrode with excellent electrical and mechanical properties and high processability in which a metal material is coated on a substrate made of an insulating fabric, and a method for manufacturing the flexible electrode.

BACKGROUND ART

With the increasing interest in portable and wearable electronic devices, there has been an increasing necessity for the development of lightweight, highly mechanically flexible electrodes. Particularly, such highly flexible electrodes are required to retain their electrical conductivity even under various mechanical stresses (bending, stretching, and twisting) and have long lifetime without performance deterioration even under various environmental conditions. The highly flexible electrodes should be human friendly. The bonding of the highly flexible electrodes with porous materials is a very important factor for high energy output per unit area.

General flexible electrodes are manufactured by forming a film of a highly electrically conductive electrode material on a substrate. Carbon materials such as carbon nanotubes (CNTs) and graphene, metal wires, and conductive polymers are currently receiving attention as electrode materials due to their large areas. These structural features ensure high electrical conductivity per unit area and good mechanical flexibility of the electrode materials. However, the synthesis of the electrode materials requires high temperatures for the purpose of reducing loss of electrical conductivity and involves time-consuming complicated processes such as chemical reduction for stronger bonding, which is disadvantageous in terms of cost.

Thus, there is a need to develop an electrode that is manufactured in a simple and rapid process and is anticipated to have excellent electrical properties while maintaining high mechanical flexibility.

DETAILED DESCRIPTION OF THE INVENTION

Problems to be Solved by the Invention

The present invention has been made in an effort to solve the problems of the prior art and one aspect of the present invention is to provide a highly flexible electrode in which a metal material is coated at high packing density on a fabric substrate by electroplating to achieve high electrical conductivity and mechanical stability.

Another aspect of the present invention is to provide an electrode that uses a fabric substrate whose porous structure is maintained during manufacturing and that is thus applicable to a current collector of an energy storage device.

Means for Solving the Problems

A fabric-based flexible electrode according to the present invention includes a substrate made by interlacing a plurality of fibers, a bonding layer formed by adsorbing an amine group ($NH_2$)-containing monomolecular material on the substrate, a nanoparticle layer formed by coating metal nanoparticles on the bonding layer, and a plating layer formed by electroplating a metal on the nanoparticle layer.

The fibers are selected from the group consisting of polyester, cellulose, nylon, acrylic fibers, and mixtures thereof.

The monomolecular material is selected from the group consisting of tris(2-aminoethyl)amine (TREN), propane-1, 2,3-triamine, diethylenetriamine, tetrakis(aminomethyl) methane, methanetetramine, and mixtures thereof.

The metal nanoparticles are nanoparticles of at least one metal selected from the group consisting of Pt, Au, Ag, Al, and Cu.

The plating metal is selected from the group consisting of Au, Ag, Ni, Cu, Cr, Ti, and mixtures thereof.

A method for manufacturing a fabric-based flexible electrode according to the present invention includes (a) dipping a substrate in a dispersion of an amine group ($NH_2$)-containing monomolecular material to adsorb the amine group-containing monomolecular material on the substrate, (b) dipping the substrate adsorbed by the amine group-containing monomolecular material in a dispersion of metal nanoparticles to form a nanoparticle layer, and (c) electroplating the substrate, where the nanoparticle layer is formed, with a metal.

The method further includes (d) cleaning the electroplated substrate.

The method further includes (e) drying the cleaned substrate.

The fibers are selected from the group consisting of polyester, cellulose, nylon, acrylic fibers, and mixtures thereof.

The monomolecular material is selected from the group consisting of tris(2-aminoethyl)amine (TREN), propane-1, 2,3-triamine, diethylenetriamine, tetrakis(aminomethyl) methane, methanetetramine, and mixtures thereof.

The metal nanoparticles are nanoparticles of at least one metal selected from the group consisting of Pt, Au, Ag, Al, and Cu.

The electroplating metal is selected from the group consisting of Au, Ag, Ni, Cu, Cr, Ti, and mixtures thereof.

The features and advantages of the present invention will become apparent from the following description with reference to the accompanying drawings.

Prior to the detailed description of the invention, it should be understood that the terms and words used in the specification and the claims are not to be construed as having common and dictionary meanings but are construed as having meanings and concepts corresponding to the technical spirit of the present invention in view of the principle that the inventor can define properly the concept of the terms and words in order to describe his/her invention with the best method.

Effects of the Invention

According to the present invention, the metal material is coated on the insulating fabric substrate with high flexibility in a simple and rapid manner by electroplating to achieve high electrical conductivity, mechanical strength, and processability of the flexible electrode.

In addition, a high bonding strength between the particles is ensured and many pores of the fabric remain the same in the electrode of the present invention. Due to these features, the electrode of the present invention is suitable for use in a current collector of an anergy storage device. In this case, high ion mobility and good driving stability of the current collector can be ensured.

The electrode of the present invention can be applied to not only anergy storage devices but also electrical devices where light weight and high flexibility are needed. The use of electroplating does not impose any limitation on the size and shape of the electrode due to its simplicity.

BRIEF DESCRIPTION OF THE DRAWINGS

FIG. 1 schematically illustrates a fabric-based flexible electrode of the present invention.

FIG. 2 is a flowchart illustrating a method for manufacturing a fabric-based flexible electrode according to the present invention.

FIG. 3 is an image showing a fabric-based flexible electrode manufactured in accordance with a method of the present invention.

FIG. 4 shows scanning electron microscopy (SEM) images (A) before and (B) after electroplating when a fabric-based flexible electrode was manufactured in Example 1.

BEST MODE FOR CARRYING OUT THE INVENTION

Other objects, advantages, and novel features of the invention will become more apparent from the following detailed description and preferred embodiments with reference to the accompanying drawings. In the drawings, the same elements are denoted by the same reference numerals even though they are depicted in different drawings. In the description of the present invention, detailed explanations of related art are omitted when it is deemed that they may unnecessarily obscure the essence of the present invention.

Preferred embodiments of the present invention will now be described with reference to the accompanying drawings.

FIG. 1 schematically illustrates a fabric-based flexible electrode of the present invention.

As illustrated in FIG. 1, the fabric-based flexible electrode includes a substrate 10 made by interlacing a plurality of fibers 11, a bonding layer 20 formed by adsorbing an amine group ($NH_2$)-containing monomolecular material on the substrate 10, a nanoparticle layer 30 formed by coating metal nanoparticles 31 on the bonding layer 20, and a plating layer 40 formed by electroplating a metal on the nanoparticle layer 30.

The flexible electrode of the present invention has excellent electrical and mechanical properties and high processability. Flexible electrodes for electronic devices such as wearable electronic devices should maintain their inherent electrical conductivity even under mechanical stresses. Conventional electrodes use carbon materials such as carbon nanotubes (CNTs) and graphene, metal wires, and conductive polymers. However, the synthesis of these electrode materials requires high temperatures for the purpose of reducing loss of electrical conductivity and involves time-consuming complicated processes such as chemical reduction for stronger bonding, which is disadvantageous in terms of cost. The present invention has been made as a solution to the above-described problems.

As described above, the fabric-based flexible electrode of the present invention includes a substrate 10, a bonding layer 20, a nanoparticle layer 30, and a plating layer 40.

The substrate 10 is made of a fabric woven by interlacing a plurality of fibers 11. The fibers 11 are long, thin, and softly bendable linear materials. The fibers 11 include both natural and synthetic fibers. Accordingly, the substrate 10 can be made by spinning natural fibers or synthetic fibers or a blend of natural and synthetic fibers. The fibers 11 are selected from the group consisting of polyester, cellulose, nylon, acrylic fibers, and mixtures thereof but are not necessarily limited thereto. The fibers 11 are not limited to a particular type as long as they can be interlaced to form a desired shape of the substrate 10.

The substrate 10 can be made by various processes, typically weaving, using the fibers 11, but the processes are not intended to limit the scope of the present invention. Any process by which a flat surface of the substrate 10 can be provided may be used without limitation in the present invention. For example, the substrate 10 may be prepared by a papermaking process, including a process for making traditional Korean paper called Hanji by dispersing fibers in water such that the fibers 11 are spread thinly and get entangled.

The resulting substrate 10 made of the fibers 11 has a plurality of micropores.

The bonding layer 20 is formed by adsorbing a monomolecular material on the substrate. The monomolecular material contains one or more amine groups ($NH_2$) that increase the affinity for metal nanoparticles 31, which will be described later. The monomolecular material is not only bonded to the surface of the substrate 10 but also penetrates into the substrate 10 through the pores. As a result, the monomolecular material can be adsorbed to the outer surfaces of the fibers 11 exposed to the outside and the fibers 10 arranged inside the substrate. The monomolecular material can be selected from the group consisting of tris(2-aminoethyl)amine (TREN), propane-1,2,3-triamine, diethylenetriamine, tetrakis(aminomethyl)methane, methanetetramine, and mixtures thereof but is not necessarily limited thereto. Any monomolecular material containing amine groups capable of fixing metal nanoparticles 31 may be used without limitation in the present invention.

The nanoparticle layer 30 is formed by coating metal nanoparticles 31 on the bonding layer 20. The nanoparticle layer 30 is fixed to the substrate 10 through the bonding layer 20 and may be coated on the fibers 11 exposed to the outside and the fibers arranged inside the substrate 10.

On the other hand, metals have low resistance whereas thin films composed of metal particles exhibit insulating properties when their surface is surrounded by long organic ligands of the metal particles. Thus, the amine group-containing monomolecular material substituted with insulating organic ligands is used in the present invention to improve the bonding strength between the metal nanoparticles 31 and to impart electrical conductivity to the nanoparticle layer 30. The metal nanoparticles 31 may be nanoparticles of at least one metal selected from the group consisting of Pt, Au, Ag, Al, and Cu but the metal of the metal nanoparticles is not necessarily limited to the above-mentioned type.

The plating layer 40 is formed by electroplating a metal on the nanoparticle layer 30. For example, the plating metal may be selected from the group consisting of Au, Ag, Ni, Cu, Cr, Ti, and mixtures thereof, which are stable at room temperature due to their low ionization tendencies and have high electrical conductivities.

The plating metal is coated at high packing density by electroplating to further improve the electrical conductivity of the electrode. The electroplating enables very uniform adsorption of the plating metal while maintaining the porosity of the substrate 10, with the result that the plating layer 40 can be uniformly formed on the fibers 11 exposed to the outside and the fibers 11 arranged inside the substrate 10. In addition, the electroplating is performed in a simple manner in a short time, shortening the time it takes to manufacture the electrode and contributing to manufacturing cost reduction. Furthermore, the electroplating can determine the size and shape of the plating layer according to the intended use of the electrode, enabling various designs of the electrode.

Overall, according to the present invention, the metal material is coated on the insulating fabric substrate 10 with high flexibility in a simple and rapid manner by electroplating to achieve high electrical conductivity, mechanical strength, and processability of the flexible electrode.

A high bonding strength between the particles is ensured and many pores of the fabric remain the same in the fabric-based flexible electrode of the present invention. Due to these features, the fabric-based flexible electrode of the present invention can be applied to a current collector of an energy storage device. In this case, a flow of electrolyte into the current collector is facilitated and the large surface area of the fabric-based flexible electrode compared to pore-free planar electrodes can maximize the number of particles introduced per unit area of the current collector. That is, the use of the fabric-based flexible electrode ensures high ion mobility and driving stability of the current collector.

MODE FOR CARRYING OUT THE INVENTION

A method for manufacturing a fabric-based flexible electrode will be described hereinbelow.

FIG. 2 is a flowchart illustrating a method for manufacturing a fabric-based flexible electrode according to the present invention.

Referring to FIG. 2, the method of the present invention includes (S100) dipping a substrate in a dispersion of an amine group ($NH_2$)-containing monomolecular material to adsorb the amine group-containing monomolecular material on the substrate, (S200) dipping the substrate adsorbed by the amine group-containing monomolecular material in a dispersion of metal nanoparticles to form a nanoparticle layer, and (S300) electroplating the substrate, where the nanoparticle layer is formed, with a metal.

A fabric-based flexible electrode manufactured by the method of the present invention is the same as that described above and detailed and repeated descriptions thereof are omitted or only briefly presented herein.

First, a substrate is dipped in a dispersion of an amine group ($NH_2$)-containing monomolecular material to adsorb the amine group-containing monomolecular material on the substrate (S100). The substrate is made by interlacing a plurality of fibers, leaving a plurality of pores therein. Thus, the monomolecular material is adsorbed to the surfaces of the fibers exposed to the outside and the fibers arranged inside the substrate through the pores to form a bonding layer on the substrate.

Here, the dispersion is prepared by dispersing the amine group-containing monomolecular material in an organic solvent.

Next, the substrate, where the bonding layer is formed, is dipped in a dispersion of metal nanoparticles (S200). The metal nanoparticles form a nanoparticle layer on the bonding layer by layer-by-layer (LBL) assembly with the bonding layer. Also here, the metal nanoparticles reach the bonding layer arranged inside the substrate through the pores of the substrate to form a nanoparticle layer inside the substrate.

The dispersion can be prepared by dispersing the metal nanoparticles in a nonpolar solvent.

Finally, the substrate, where the nanoparticle layer is formed, is electroplated with a metal (S300). The electroplating is performed by immersing the substrate as a cathode and the plating metal as an anode in an electrolyte solution, connecting a power supply to both electrodes, and supplying electricity to both electrodes. As a result of the electroplating, a plating layer is formed on the nanoparticle layer.

The substrate, on which the bonding layer, the nanoparticle layer, and the plating layer are formed in this order, may be cleaned with a suitable solvent such as distilled water. Thereafter, the cleaned substrate may be dried with an inert gas such as nitrogen gas.

The present invention will be explained in more detail with reference to the following examples.

EXAMPLE 1

Manufacture of Fabric-Based Flexible Electrode

FIG. 3 is an image showing a fabric-based flexible electrode manufactured in accordance with a method of the present invention.

In this example, traditional Korean paper (called Hanji) made of cellulose was prepared as a substrate (see (A) of FIG. 3) and dispersed in tris(2-aminoethyl)amine (TREN) as an organic solvent to prepare a first solution. Au nanoparticles stabilized with tetraoctylammonium bromide (TOA) as a hydrophobic ligand were synthesized and dispersed in a nonpolar solvent to prepare a second solution.

The substrate was sequentially immersed in the first solution and the second solution to form a structure (TREN/TOA-Au NP) in which the TREN and the TOA-stabilized Au nanoparticles were stacked by layer-by-layer assembly (see (B) of FIG. 3). Then, the structure was electroplated with a nickel plating solution in a Watt's bath (see (C) of FIG. 3).

COMPARATIVE EXAMPLE 1

An electrode was manufactured in the same manner as in Example 1, except that nickel plating was not performed. The electrode had a structure in which a bonding layer and a nanoparticle layer were sequentially formed on fibers (see (B) of FIG. 3).

EVALUATION EXAMPLE 1

Electrical Conductivity Comparison

The electrodes manufactured in Example 1 and Comparative Example 1 were measured for sheet resistance. The electrode manufactured in Example 1 had a sheet resistance of $4.65\times10^{-2}$ Ω/sq. and the electrode manufactured in Example 1 had a sheet resistance of $3.75\times10^{6}$ Ω/sq. The electrical conductivity of the inventive fabric-based flexible electrode was found to be comparable to that of general metals.

EVALUATION EXAMPLE 2

Evaluation of Electroplating

The cellulose surface of the electrode manufactured in Example 1 was observed with a scanning electron microscope.

FIG. 4 shows scanning electron microscopy (SEM) images (A) before and (B) after electroplating when the electrode was manufactured in Example 1.

The SEM images reveal that the electroplated nickel was very uniformly distributed and coated even on the surface of the cellulose arranged inside the substrate (see (B) of FIG. 4) compared to on the pure cellulose surface (see (A) of FIG. 4).

Although the present invention has been described herein with reference to the specific embodiments, these embodiments do not serve to limit the invention and are set forth for illustrative purposes. It will be apparent to those skilled in the art that modifications and improvements can be made without departing from the spirit and scope of the invention.

Such simple modifications and improvements of the present invention belong to the scope of the present invention, and the specific scope of the present invention will be clearly defined by the appended claims.

INDUSTRIAL APPLICABILITY

The highly flexible electrode of the present invention is manufactured by coating a metal material at high packing density on a fabric substrate by electroplating to achieve high electrical conductivity and mechanical stability. Due to these advantages, the present invention is considered industrially applicable.

The invention claimed is:

1. A fabric-based flexible electrode comprising a substrate made by interlacing a plurality of fibers, a bonding layer formed by adsorbing an amine group ($NH_2$)-containing monomolecular material on the substrate, a nanoparticle layer formed by coating metal nanoparticles on the bonding layer, and a plating layer formed by electroplating a metal on the nanoparticle layer, wherein the monomolecular material is selected from the group consisting of tris(2-aminoethyl)amine (TREN), propane-1,2,3-triamine, tetrakis(aminomethyl)methane, methanetetramine, and mixtures thereof, and wherein the plating metal is selected from the group consisting of Au, Ag, Ni, Cu, Cr, Ti, and mixtures thereof.

2. The fabric-based flexible electrode according to claim 1, wherein the fibers are selected from the group consisting of polyester, cellulose, nylon, acrylic fibers, and mixtures thereof.

3. The fabric-based flexible electrode according to claim 1, wherein the metal nanoparticles are nanoparticles of at least one metal selected from the group consisting of Pt, Au, Ag, Al, and Cu.

4. A method for manufacturing a fabric-based flexible electrode comprising (a) dipping a substrate made by interlacing a plurality of fibers in a dispersion of an amine group ($NH_2$)-containing monomolecular material to adsorb the amine group-containing monomolecular material on the substrate, (b) dipping the substrate adsorbed by the amine group-containing monomolecular material in a dispersion of metal nanoparticles to form a nanoparticle layer, and (c) electroplating the substrate, where the nanoparticle layer is formed, with a metal, wherein the monomolecular material is selected from the group consisting of tris(2-aminoethyl)amine (TREN), propane-1,2,3-triamine, tetrakis(aminomethyl)methane, methanetetramine, and mixtures thereof.

5. The method according to claim 4, further comprising (d) cleaning the electroplated substrate.

6. The method according to claim 5, further comprising (e) drying the cleaned substrate.

7. The method according to claim 4, wherein the fibers are selected from the group consisting of polyester, cellulose, nylon, acrylic fibers, and mixtures thereof.

8. The method according to claim 4, wherein the metal nanoparticles are nanoparticles of at least one metal selected from the group consisting of Pt, Au, Ag, Al, and Cu.

9. The method according to claim 4, wherein the electroplating metal is selected from the group consisting of Au, Ag, Ni, Cu, Cr, Ti, and mixtures thereof.

10. The fabric-based flexible electrode according to claim 1, wherein the nanoparticle layer is a thin film comprising the metal nanoparticles in contact with each other.

11. The method according to claim 4, wherein the nanoparticle layer is a thin film comprising the metal nanoparticles in contact with each other.

* * * * *